US010835083B2

(12) United States Patent
Raymond

(10) Patent No.: US 10,835,083 B2
(45) Date of Patent: Nov. 17, 2020

(54) SHOWER CURTAIN LINER RIB, LINER, AND SYSTEM

(71) Applicant: Patrick Raymond, New York, NY (US)

(72) Inventor: Patrick Raymond, New York, NY (US)

( * ) Notice: Subject to any disclaimer, the term of this patent is extended or adjusted under 35 U.S.C. 154(b) by 0 days.

(21) Appl. No.: 16/399,007

(22) Filed: Apr. 30, 2019

(65) Prior Publication Data

US 2019/0254487 A1 Aug. 22, 2019

Related U.S. Application Data

(63) Continuation of application No. 15/484,576, filed on Apr. 11, 2017, now Pat. No. 10,278,548.

(60) Provisional application No. 62/321,280, filed on Apr. 12, 2016.

(51) Int. Cl.
*A47K 3/38* (2006.01)

(52) U.S. Cl.
CPC ..... *A47K 3/38* (2013.01)

(58) Field of Classification Search
CPC ..... A47K 3/38
USPC ..... 4/558
See application file for complete search history.

(56) References Cited

U.S. PATENT DOCUMENTS 3,872,520 A * 3/1975 Tyconik ..... A47K 3/38 4/610
5,007,120 A * 4/1991 Annand ..... A47K 3/38 4/558
5,097,541 A * 3/1992 Annand ..... A47K 3/38 4/558
5,732,420 A * 3/1998 Micciche ..... A47K 3/38 4/559
5,771,504 A * 6/1998 Steiner ..... A47K 3/38 4/558
6,488,070 B1 * 12/2002 Cox ..... A47K 3/38 160/84.01
8,122,531 B2 * 2/2012 Li ..... A47K 3/38 160/349.1
D655,552 S * 3/2012 Beyda ..... A47K 3/38 D6/575
D655,553 S * 3/2012 Beyda ..... A47K 3/38 D6/575
9,603,491 B2 * 3/2017 Royal ..... A47K 3/00
10,278,548 B2 * 5/2019 Raymond ..... A47K 3/38
2013/0067704 A1 * 3/2013 Raymond ..... A47K 3/38 24/716
2013/0180670 A1 * 7/2013 Judkins ..... A47H 23/00 160/84.04

(Continued)

*Primary Examiner* — Lori L Baker
(74) *Attorney, Agent, or Firm* — Troutman Pepper Hamilton Sanders LLP

(57) ABSTRACT

A shower liner system configured to engage a shower rod having a rib with a strut slidably engaging the shower rod and a panel disposed approximately perpendicular to the strut having a top end and a bottom end. A liner can include a waterproof body with a top header disposed approximate the shower rod and having an engagement point, and a second header disposed away from the first header toward the floor. The top end of the panel engages the first header and the second end of the panel engages the second header. The rib is configured to hang at least a portion of the liner at an angle to the shower rod.

3 Claims, 6 Drawing Sheets

(56) References Cited

U.S. PATENT DOCUMENTS

| | | | | |
|---|---|---|---|---|
| 2014/0101842 | A1* | 4/2014 | Tsibulevskiy | A47K 3/36 4/607 |
| 2014/0298581 | A1* | 10/2014 | Chenoweth | A47K 3/38 4/608 |
| 2015/0135426 | A1* | 5/2015 | McFall | A47K 3/38 4/610 |
| 2016/0106251 | A1* | 4/2016 | Ramey | A47K 3/38 4/608 |
| 2016/0143486 | A1* | 5/2016 | Tsibulevskiy | A47K 3/38 29/428 |
| 2016/0220076 | A1* | 8/2016 | Haas | B29C 59/025 |
| 2017/0290468 | A1* | 10/2017 | Raymond | A47K 3/38 |
| 2019/0254487 | A1* | 8/2019 | Raymond | A47K 3/38 |
| 2020/0077830 | A1* | 3/2020 | Song | A47K 3/34 |

* cited by examiner

SHOWER CURTAIN LINER RIB, LINER, AND SYSTEM

CROSS-REFERENCE TO RELATED APPLICATIONS

The present application is a continuation application of U.S. patent application Ser. No. 15/484,576 filed Apr. 11, 2017, which claims priority to U.S. Provisional Application No. 62/321,280, filed Apr. 12, 2016. The entire contents of which are hereby incorporated by reference.

FIELD OF THE INVENTION

The invention relates to a system designed to hold a shower curtain away from the showering area while a person is taking a shower.

BACKGROUND

A shower curtain liner is frequently used to keep running water within a bathtub during a shower. A shower curtain liner typically has up to 12 grommet holes at the top, and it hangs from a set of up to 12 hooks that each engages with a grommet hole. The shower curtain liner collectively hangs from a curtain rod installed above the shower head and above the outer edge of the bathtub. The shower curtain liner may share the hooks with a shower curtain, which is a second hanging liner that is frequently used for decorative or aesthetic purposes. The shower curtain typically is outside of the bathtub, and the liner remains inside the bathtub. Due to the flow of water and air during a shower, the shower curtain liner tends to swell inwardly toward the showering area, which is the area within a bathtub where a person stands during a shower. The shower curtain liner tends to swell inwardly and occupy space in the showering area. The shower curtain liner may also cling to the body of the person while taking a shower. This may provide an uncomfortable feeling for the person standing in the tub.

Prior solutions created stiff members with counterweights to push the shower curtain liner out from the user. However, these solutions are bulky and expensive to manufacture, package and ship.

SUMMARY

The present invention is a shower curtain liner rib and system designed to hold a shower curtain away from the showering area while a person is taking a shower. The shower curtain liner rib has a first side, including a first panel having a top end and a bottom end, a second panel having a top end and a bottom end, a first tab extending from the bottom end of the first panel, and a third panel having a top end and a bottom end that is hingedly attached to the top end of the first panel. The first panel includes an incision at its top end, and the third panel includes a first clasp at its top end. The first panel and second panel are hingedly attached at a first valley fold, and the first panel and third panel are hingedly attached at a second valley fold. The first and second panels run perpendicular across the first valley fold. The second panel includes a rod engager. The rod engager is covered with a protective material such as hard plastic.

In another example, the shower curtain liner rib includes a second side which has a fourth panel, fifth panel, sixth panel, a second tab, and a second clasp. The second side is arranged in the mirror image of the first side. The first side and second side are attached at a mountain fold that runs in the middle of the rib. The first clasp and second clasp are hooked together. The fifth panel includes a rod engager that is covered with a protective material such as hard plastic.

In yet another example, the shower curtain liner rib is attached to a shower liner. The shower liner has a top end, a second region, and a bottom end. The top end includes a first header and the second region includes a second header. Each of the headers is a thin strip of the shower liner material that overlaps with an additional strip of shower liner material and is attached to the liner. The first header is lined with a series of openings, sometimes known as grommet holes. These holes, in certain examples, can be sized and spaced to receive standard shower curtain rings. However, they may not take rings in examples of the present invention. The second region has a second header that can be lined with a series of slits that form pockets. The slits are formed on the additional strip of material so pockets form in the region between the first and second strip of the header. The slits are parallel to the hanging direction of the shower liner.

The present invention also relates to a shower curtain liner system comprising a shower curtain liner rib having a first side and a second side, where each side has a set of panels, a tab, one incision, and one rod engager. The sides are attached at a mountain fold and arranged as mirror images of one another. A shower liner comprising a first and second header is also included, where the first header is lined with a series of openings and the second header is lined with a series of slits that form pockets. The two clasps are hooked together, and the two incisions are inserted into the openings of the first header. The two tabs are inserted into the slits of the second header. The tabs are inserted into the slits so they sit perpendicularly to the shower liner. Each side of the rib includes a rod engager that is ringed with a protective material, where the regions form a circle in the middle of the rib. In some embodiments, the circle has a diameter of 1.655 inches. In some embodiments, the system may include multiple shower liner ribs attached to a single shower liner.

BRIEF DESCRIPTION OF THE DRAWINGS

The above and further aspects of this invention are further discussed with reference to the following description in conjunction with the accompanying drawings, in which like numerals indicate like structural elements and features in various figures. The figures depict one or more implementations of the inventive ribs, by way of example only, not by way of limitation.

DETAILED DESCRIPTION

Figure 1:
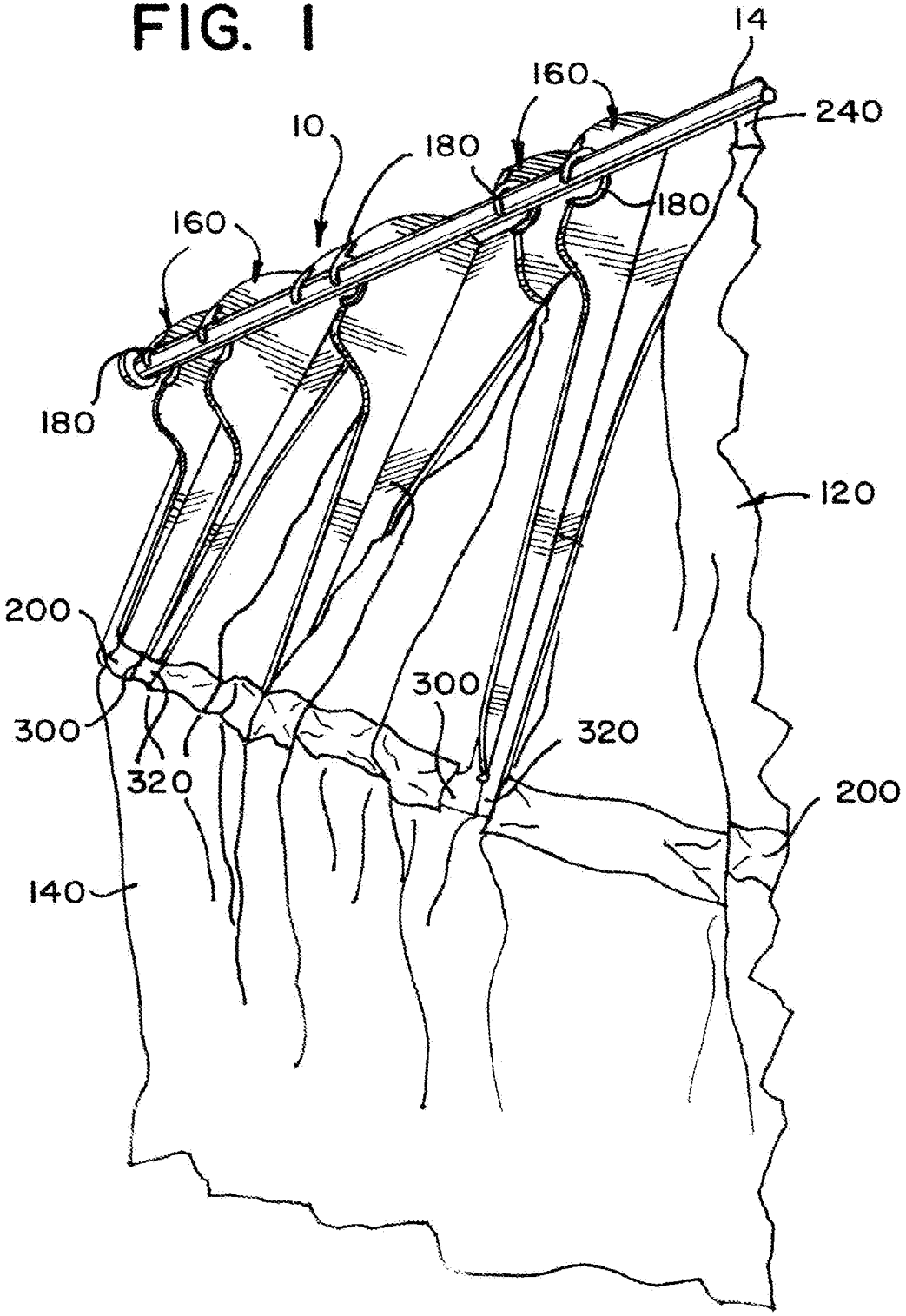
FIG. 1 illustrates an example of a shower curtain liner system in the perspective of outside the showering area.
Figure 2:
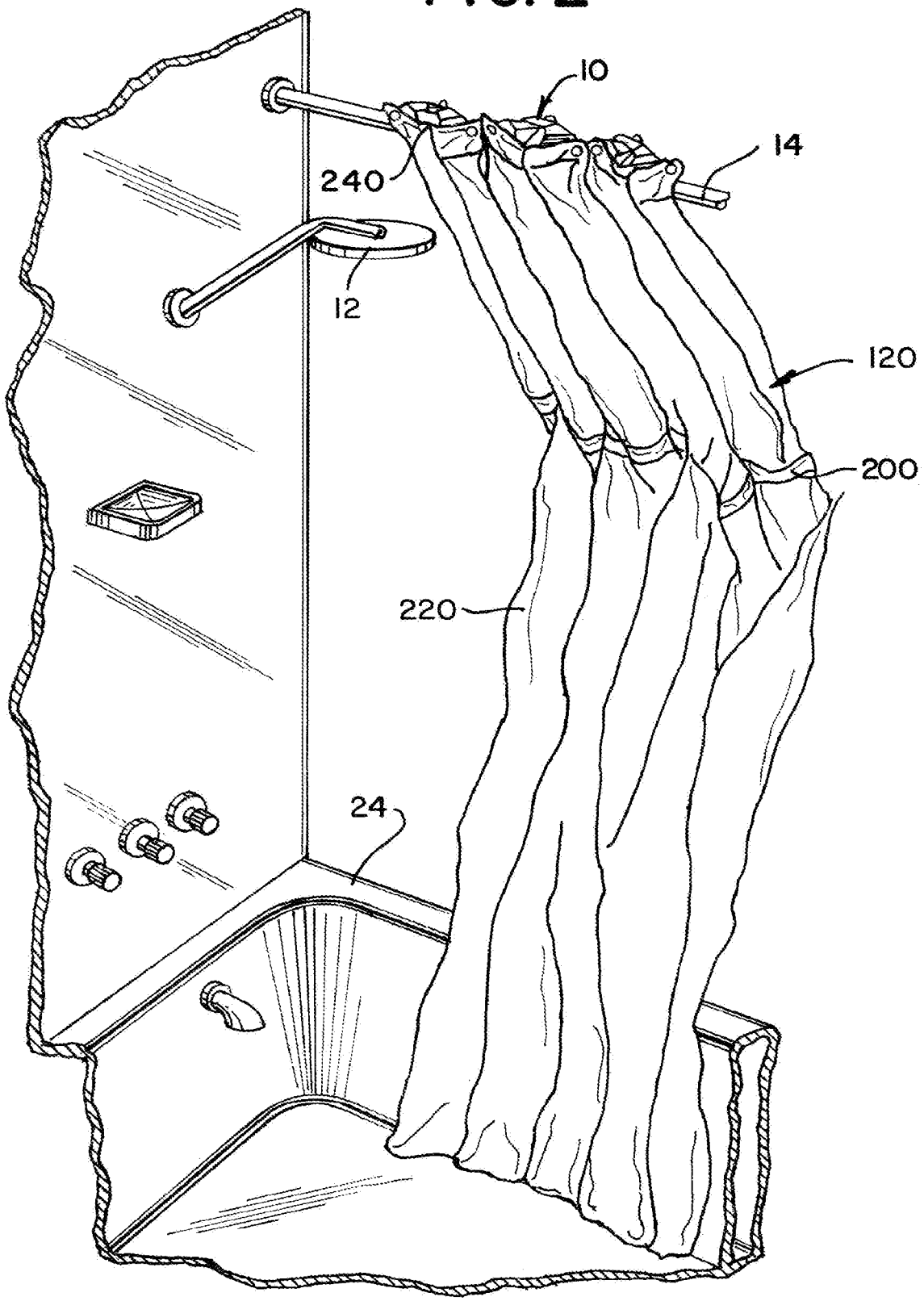
FIG. 2 illustrates the shower curtain liner system in the perspective of inside the showering area.

A shower curtain liner system 10 is shown in FIGS. 1 and 2. A bathtub shower traditionally consists of a bathroom side (FIG. 1) and a showering area (FIG. 2) that includes a shower head 12 and a tub 24 or other vessel where water will fall into, and a shower curtain rod 14 that hangs above the tub 24 at about the edge of the tub 24. The shower curtain liner system 10 includes one or more shower curtain ribs 160 and a shower liner 120. The shower liner 120 has a dry side 140, which is on the bathroom side or the side outside the tub 24 and away from the shower head 12. Typical shower liners have a length of 72 inches. Extra long liners can vary in length between 72 and 80 inches. FIG. 1 is a view of the dry side 140 of the shower liner 120. The liner 120 is attached to one or more shower curtain liner ribs 160. The ribs 160 have a rod engager 180, which then hangs from the curtain rod 14. Thus, the liner 120 hangs from one or more ribs 160 and the ribs 160, in turn, include the rod engager 180 that hangs on the curtain rod 14 and acts as a shower liner ring. While hanging on the rod 14 and attached to the liner 120, the rib 160 is located on and projects in the direction of the dry side 140 away from the showering area.

FIG. 2 illustrates the shower side 220 view of the shower curtain liner system 10. The shower side 220 is the side inside of the tub 24 where a person takes a shower, and it includes the bathtub 24, rod 14, and shower head 12. The shower side 220 view of the shower curtain liner system 10 includes viewing the rib 160 supporting the liner 120 from the dry side 140, through the liner 120. The rib 160 is not on the shower side 220 and, in examples, does not get wet from the shower head 12. The shower liner 120 may include a first header 240 and a second header 200. The headers 200, 240 are the regions where the rib 160 engages the liner 120.

As can be seen in both FIGS. 1 and 2, examples of the invention allow one or more ribs 160 to act as the curtain rings and suspend the shower liner 120 from a standard shower rod 14. Examples of the ribs 160, as discussed further below, can be shaped and/or weighted such that they do not hang from the curtain rod 14 perpendicular to the rod 14. The majority of the rib 160 hangs at an outward sloping angle away from the shower side 220 and toward the dry side 140. This pivoting effect can be caused by using the shower rod 14 as a fulcrum and balancing the rib 160 accordingly. As with any fulcrum, there can be a portion of the rib 160 over the rod 14 that does tilt toward the shower side 220. However, since it is over the top of the rod 14, that portion of the rib 160 does not interfere with the bather.

Thus, as can be seen in FIG. 2, the portion where the liner 120 and rib 160 are engaged can be pulled outwardly away from the bathtub 24, allowing additional room on the shower side 220. In this example, the rib 160 ends at the second header 200. The shower liner 120 below the second header 200 can hang freely at the edge of the bathtub 24. As can be seen in both figures, the liner 120 remains generally taut between the ribs 160 and does not sag between the ribs 160. This is based on the shape of the ribs 160 described below.

The rib 160 can be formed by any means known to those of ordinary skill. In the below described example, the rib 160 is formed from a single sheet of stamped polymer and folded into form for ease of manufacture and assemble. Other examples can contemplate a single piece of extruded plastic that can perform similar functions as described herein or any other examples regardless of manufacturing technique and material.

Figure 4:
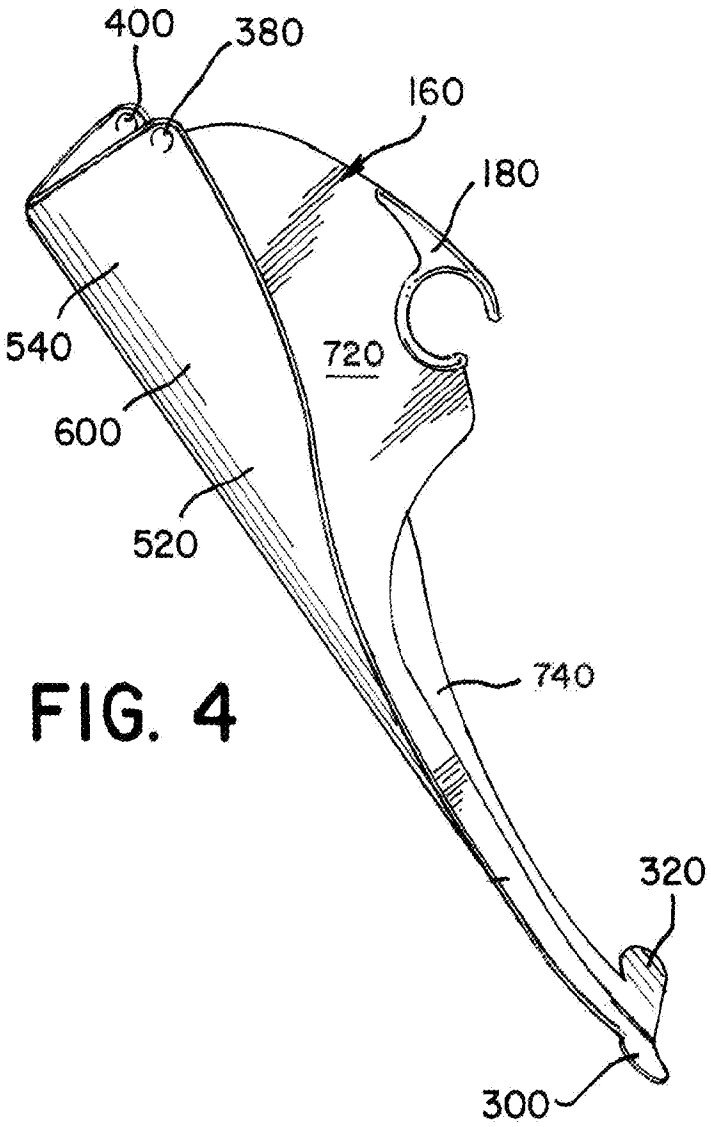
FIG. 4 illustrates a left side view of the shower curtain liner rib in a partially folded state.
Figure 3:
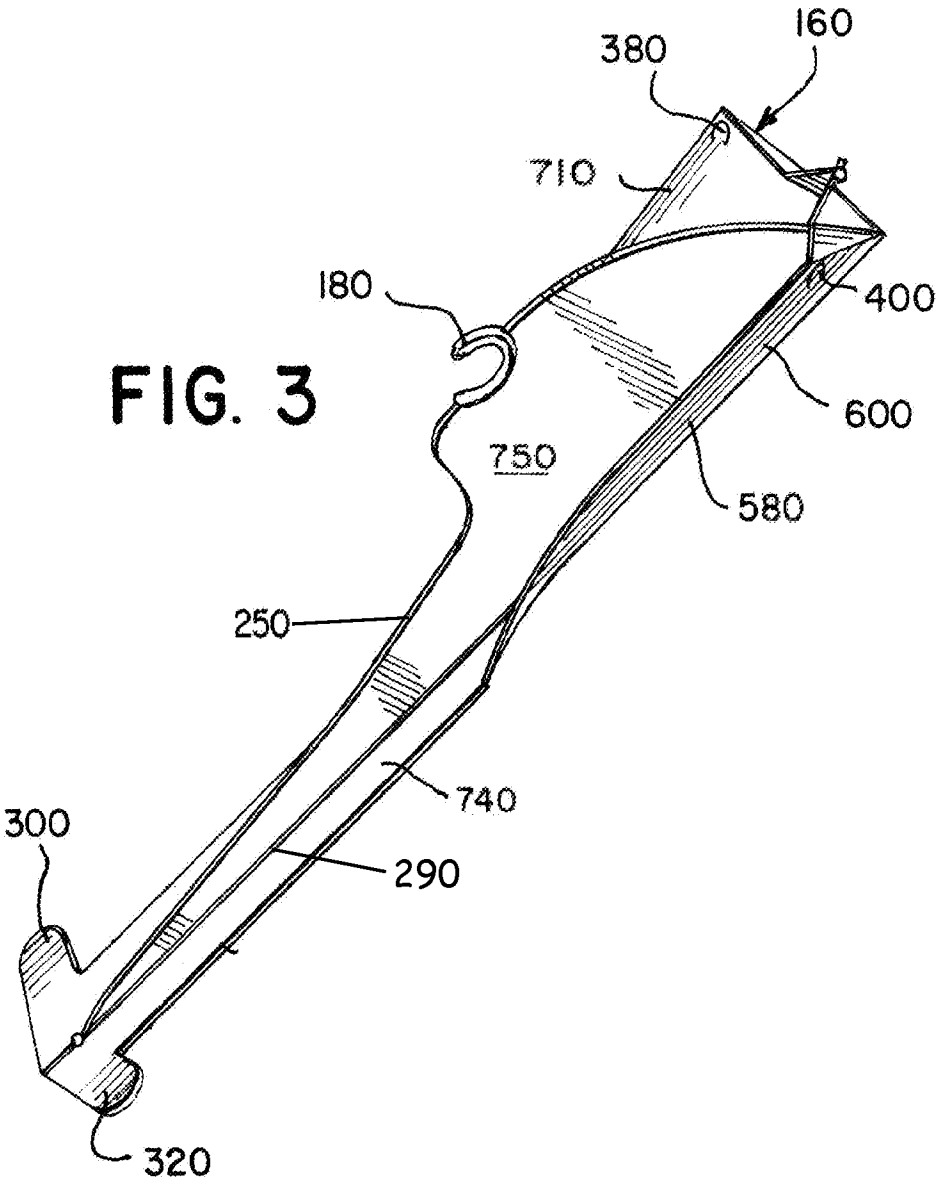
FIG. 3 illustrates a top right perspective of the shower curtain liner rib.
Figure 5:
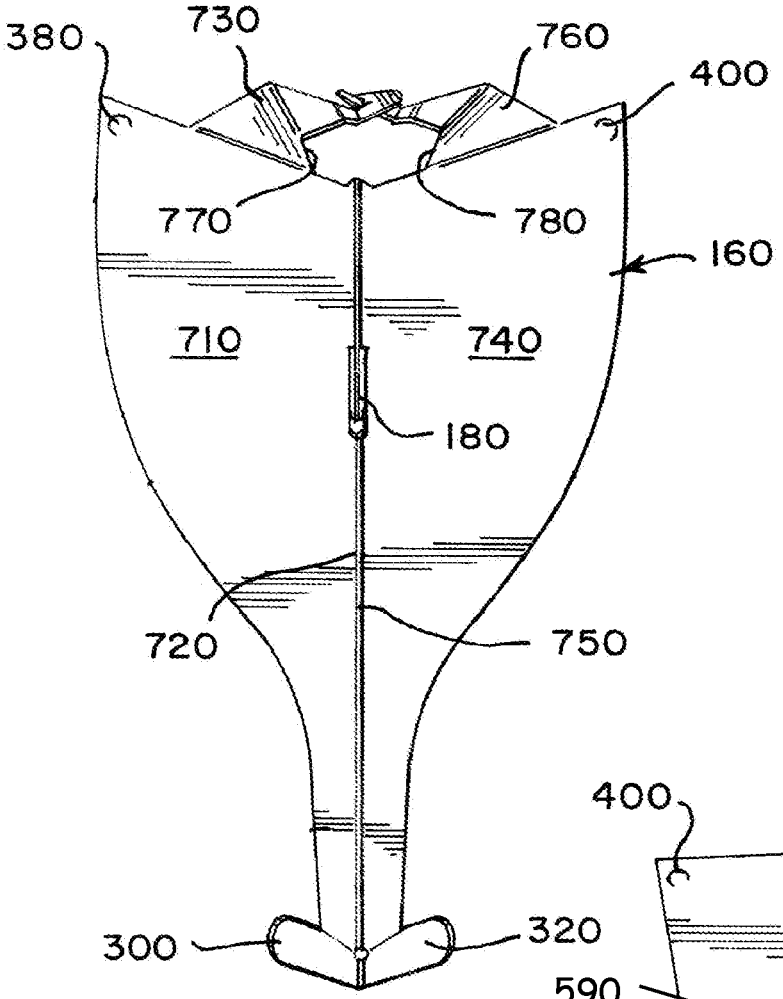
FIG. 5 illustrates the front of the shower curtain liner rib in a folded state.
Figure 6:
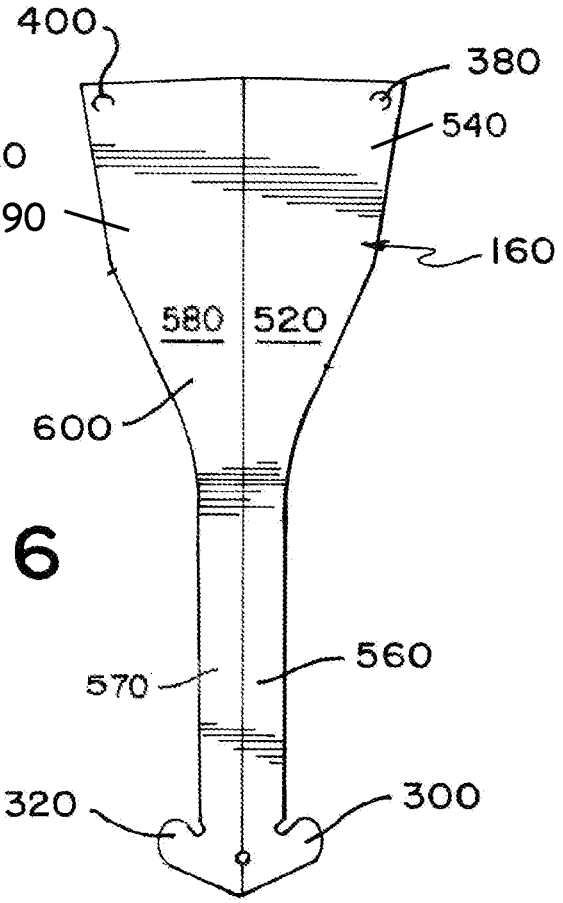
FIG. 6 illustrates the rear view of the shower curtain liner rib in its folded state.

FIGS. 3-6 illustrate views of an example of the rib 160 formed by folding and in a partially folded state. FIGS. 3 and 4 illustrate the two side views while FIGS. 5 and 6 illustrate the front and rear sides (respectively). The shower liner rib 160 is a stiff supporting detachable structure that engages with both the liner 120 and the shower rod 14 in the system 100. The rib 160 has a front side 440 and a backside 600. The rib 160 can be made of any suitable material such as plastic or metal or cardboard, as long as the material, in the current examples, can withstand the temperatures and humidity, and outright contact with water, which is typical of a bathroom shower. The rib 160 engages with the liner 120 at least in two places on the liner 120. One or more tabs 300, 320 located at the bottom of the rib 160 and at another point at the top of the rib 160, via two grommet catches 380, 400. This engagement is discussed below regarding FIGS. 7 and 8.

The rib 160 can include at least a back panel 520 and a partially perpendicular support. The panel 520 has a top 540 and bottom 560. The top 540 can be sized at least to span between two standard spaced grommet holes in the shower liner 120. In an example, the back panel 520 narrows in width as it moves toward the bottom 560. At the bottom 560, there are features again to engage the shower liner 120 at a second location below the top grommet holes. This engages the rib 160 to the liner 120. As is typical with a shower liner 120, there can be approximately 12 grommet holes, thus at least 6 ribs 160 can be disposed across the liner 120. The panel 580 has a top 590 and bottom 570. The top 590 can be sized at least to span between two standard spaced grommet holes in the shower liner 120. In an example, the back panel 580 narrows in width as it moves toward the bottom 570. At the bottom 570, there are features again to engage the shower liner 120 at a second location below the top grommet holes. This engages the rib 160 to the liner 120. As is typical with a shower liner 120, there can be approximately 12 grommet holes, thus at least 6 ribs 160 can be disposed across the liner 120.

In an example, a support is disposed approximately perpendicular to the panels 520, 580, and can be centered. The support acts as stiffener and includes a section to engage the curtain rod 14. The support can be perpendicular in certain circumstances. The bottom of the panels 520, 580 "cups" to pull taut on the liner 120. This cupping creates tension in the liner 120 fabric so it remains suspended between the ribs 160 and does not "droop" back into the shower area. Also, the top of the panels 540, 590 do not require strict right angles and can bow. Further, the "perpendicularity" is only when the curtain 120 is in the close state, i.e. covering the shower opening. When the curtain 120 is open, the panels 710, 720, 730, 740, 750, and 760 in examples 3 and 5, can fold and lay approximately parallel to the support. The "open" state is when the curtain is folded to one side of the tub 24.

Turning now to an example where the rib 160 is folded into form, FIGS. 3 and 4 illustrate the rib 160 as partially folded, but it can also be maintained in a flat state (see, FIGS. 9 and 10) or completely folded state. The rib 160 can consist of accordion folds to allow for such flexibility in size and form. Thus, when a person is using the system 10 while showering, the liner 120 expands the length of the rod 14 and the ribs 160 can slightly expand to fit the length of the rod 14 that the liner 120 covers. If a person wishes to exit the bathtub, he or she may pull the liner 120 towards one side of the rod 14. The ribs 120 may compact even further due to their accordion like features to allow the liner 120 to bunch up and create an opening.

In FIG. 3 the rib 160 has a first side, 260 which can be left and a second side 280, which can be right, with a front perspective. However, these sides 260, 280 can be reversed. The side 260 is hingedly connected by being folded at a first valley fold 270 or hinge, so the rib 160 remains in a more compact state. The right side 280 is hingedly connected by being folded at a second valley fold 290 or hinge, so the rib 160 remains in a more compact state. Side 260 and side 280 are hingedly connected by a mountain fold 250. The tabs 300, 320 are positioned at the bottom of the rib 160. In this example, the tabs 300, 320 face outward away from the mountain fold 250 and upward toward the front side 440 while the rib 160 is partially folded where they form an arch shape at the bottom of the rib 160. The rod engager 180 forms at the mountain fold 250 where the sides 260, 280 are folded.

FIG. 4 illustrates an opposite side view of the rib 160 in a partial fold. This example also shows the rib 160 having two sides 260, 280 in a mirror image, and both sides 260, 280 are identical. The tabs 300, 320 are displayed in their semi-arched position. The rod engager 180 and the mountain fold 250 both line up in between either side 260, 280 of the rib 160. The rod engager 180 is ringed with a material in this example. This material can be made of a variety of substances more durable than the material of the rib 160, and this embodiment shows the engager 180 ringed with a tough plastic. The rod engager 180 is in a semi-circle shape. This shape allows the engager 180 to easily insert and hang from the shower rod 14 as well as disengage, as needed. Further, the rod engager 180 can also be made of a smoother, non-stick, or self lubricating plastic since it must slide repeatedly back and forth across the rod 14 and should do so without noise (silent of the typical metal-on-metal squeal from metal shower rings) and as effortlessly as possible.

The semi-circle shape is advantageous because it allows the rib 160 to engage on the rod 14 securely even if a person were to slide the ribs 160 across a rod 14 when pulling a shower liner 120 opened or closed. The rib 160 can angle in a slanted position when inserted into the shower liner 120 and hanging from the shower rod 14 via the rod engager 180. In this embodiment, the bottom of the rib 160 extends out away in the opposite direction as the rod engager 180 where the rib 160 hangs from the rod 14.

The rib 160 appears in a folded state in FIG. 5. The rib 160 has a first panel 710, second panel 720, third panel 730, fourth panel 740, fifth panel 750, and sixth panel 760. Additionally, the rib 160 has a first incision 770 and a second incision 780. Side 260 includes three panels: the first panel 710, the second panel 720, and the third panel 730. Side 280 includes three panels: the fourth panel 740, the fifth panel 750, and the sixth panel 760. In this example, both sides 260, 280 are arranged as mirror images of one another. The sides 260, 280 are otherwise identical in shape and function. For example, on side 260, the first panel 710 is hingedly attached to the second panel 710 at a first valley fold 270 or hinge. On side 280, the fourth panel 740 is hingedly attached to the fifth panel 750 at a second valley fold 290 or hinge. The first panel 710 includes a tab 300, which appears in an arched shape so that it is bent slightly upward. When the rib 160 is in a flat state, the tab 300 can also remain flat (see FIGS. 9 and 10). The fourth panel 740 includes a tab 320, which appears in an arched shape so that it is bent slightly upward. When the rib 160 is in a flat state, the tab 320 can also remain flat (see FIGS. 9 and 10). In this example, because the panels 710, 720, 730, 740, 750, 760 are folded at various places, the tabs 300, 320 cups the bottom of the rib 160 and faces frontward. This allows for additional space in the showering area due to the tension created in the liner 120 fabric. Therefore, the tabs 300, 320 help suspend the liner 120 between multiple ribs 160 and not sag backwards into the shower area.

The first panel 710 is also hingedly attached at its top end to the third panel 730. The fourth panel 740 is also hingedly attached at its top end to the sixth panel 760. The third panel 730 includes a clasp 340. The sixth panel 760 includes a clasp 360. In this example, the third panel 730 and sixth panel 760 are pictured with a series of accordion folds. The third panel 730 narrows as it progresses upward before it reaches the clasp 340. The sixth panel 760 narrows as it progresses upward before it reaches the clasp 360. The mountain fold 250 is in the middle of the rib 160 separating the two sides 260, 280. When the rib 160 sits in the liner 120, this mountain fold 250 slants outward away from the showering area as the rib 160 is sitting on the rod 14.

The clasp 340 and clasp 360 at the top of the rib 160 allows the rib 160 to maintain itself in a folded state. In some embodiments, such as FIG. 5, there are two clasps, one on either side of a mountain fold 250, that clasp together. This holds the rib 160 in a compacted state.

The tabs 300, 320 included in FIGS. 3-6 slide into a shower curtain liner 120. The tabs 300, 320 can also be replaced with snaps or sleeves that attach to the shower liner 120. The tabs 300, 320 anchor the rib 160 in the liner 120 and pull the liner 120 in the direction away from the showering area when the liner 120 and rib 160 are suspended on the shower rod 14.

FIG. 6 illustrates a backside view of the rib 160. The rib 160 has a flat back surface 600 formed by two panels: the first back panel 580 (pictured on the left) and the second back panel 520 (pictured on the right). The flat back surface 600 of the rib 160 engages with the shower liner 120. The rib 160 is inserted into the liner 120 and the flat back surface 600 sits against the dry side 140 of the shower liner 120. The two grommet catches 380, 400 and two tabs 300, 320 attach to the shower liner 120 so the backside 600 remains stiff and flat against the liner 120. The flat back surface 600 engages with the liner 120 while the sides 260, 280 may be compacted in an organ fold.

Figure 7:
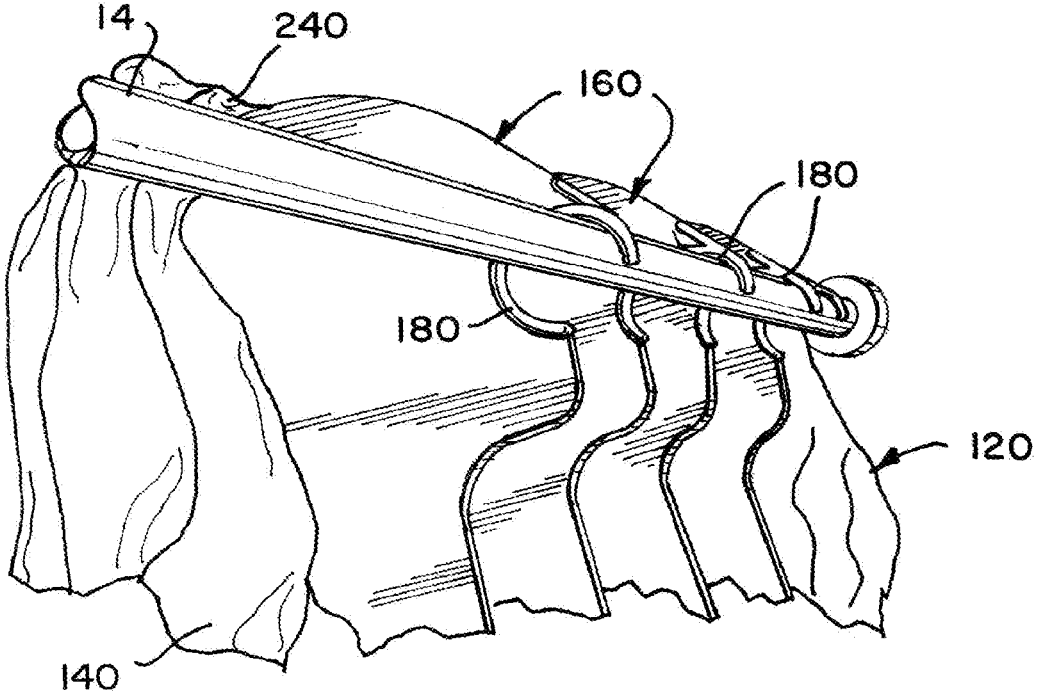
FIG. 7 illustrates a close up of the shower curtain liner rib hanging from a shower rod.

FIG. 7 is a close up of the rod engager 180 of the rib 160, as it is engaged with the shower rod 14. In this example, the rod engager 180 partially wraps around and hangs from the rod 14. The rod engager 180, in this example, is C-shaped. The rod engager 180 opens in the direction of the dry side 140 of the liner 120. The rib 160 displays part of a mountain fold 250 where the rib 160 folds while it is suspended on the rod 14. FIG. 3 is a close up of the middle of the rib 160 where the rod engager 180 forms. Partially visible is one side of the rib 160 that meets the other side at the mountain fold 250. The rod engager 180 may be covered in a protective material, which can be made of hard plastic. This material protects the rod 14 from scratches or damage and also maintains the integrity of the rod engager 180. In some shower curtain models, the rings may tend to scratch against the surface of a shower rod 14. This may result in an unpleasant noise when the shower curtain 120 is being pulled opened or closed. The protective material avoids any potential for metal-on-metal noise when the rod engager 180 is moving along the shower rod 14.

Figure 8:
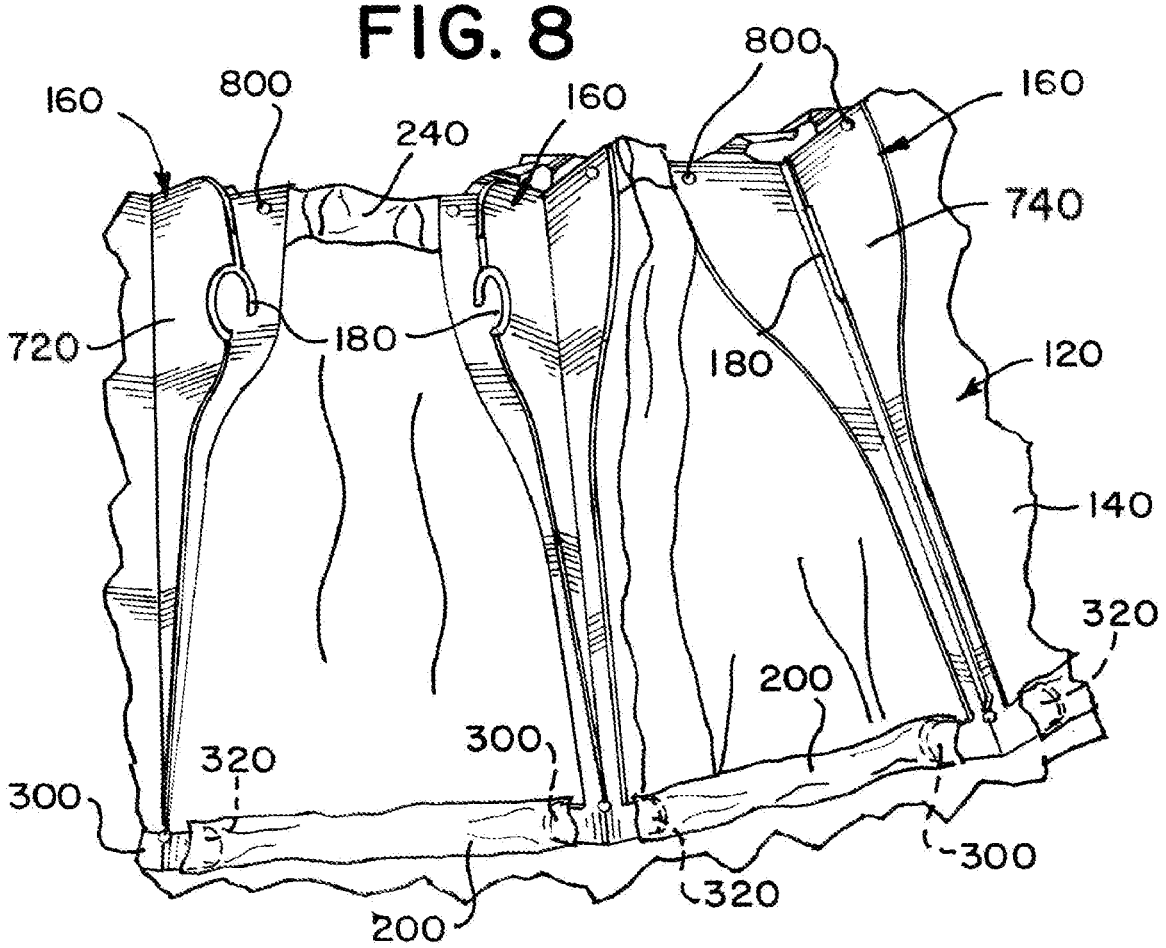
FIG. 8 illustrates a flat view of the shower curtain liner.

FIG. 8 illustrates the shower liner 120. The shower liner 120 may have two headers, a first header 240 at the top of the liner 120, and a second header 200 toward the middle of the liner 120, in examples anywhere between ⅕ to ½ the distance from the first header 240 toward the floor. The first and second header 200, 240 may be made of an additional strip of material that makes up the liner 120 or a folded over portion of the liner 120. The first header 240 includes gaps or openings 800, which may be in the form of apertures or holes. The gaps or openings 800 are suited to fit the incisions 770, 780 built into the top portion of the rib 160. The incisions 770, 780 on the rib 160 may be in the shape of a half-circle diameter, and the first header 240 gaps or openings 800 can fit this shape accordingly. The second header 200 includes slits 500 that are cut parallel to the liner 120. The tabs 300, 320 fit into these slits 500 that may be at the bottom of the rib 120. The two headers 200, 240, are where the rib 160 engages with the liner 120 to form the entire system 100. The rib 160 fits into the liner 120 to create structure that can be suspended without any sagging or excess cloth entering the showering area. Thus, the first header gaps 480 or openings 800 and second header slits 500 must match the shapes of the incisions 770, 780 and tabs on the rib 160, respectively.

In some embodiments, two gaps or openings 800 may be 7 inches apart from one another. Two of the gaps or openings may also be 12 inches away one another. In some embodiments, two slits 500 may be 1.5 inches apart from one another. The first header 240 and second header 200 may be 18.8 inches apart from one another. In some embodiments, the liner 120 may be 72 inches across and 80 inches in length.

Figure 9:
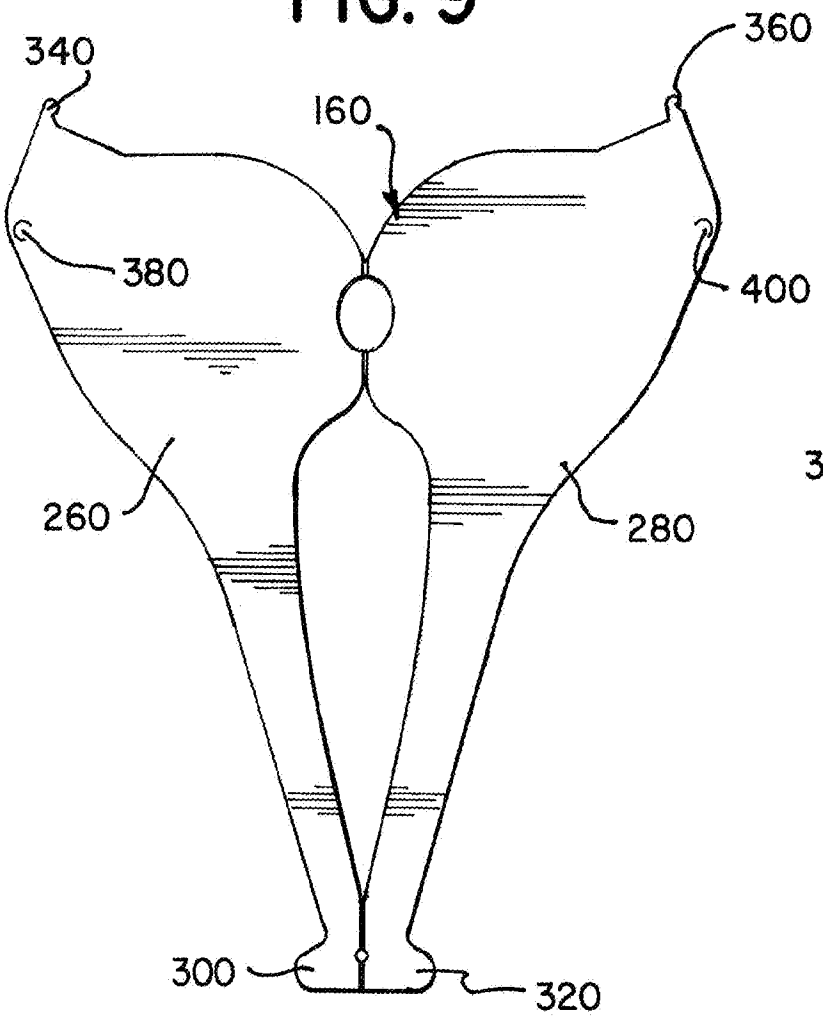

Referring to FIG. 9, the shower curtain liner rib 160 is illustrated in a flat view. The rib 160 can have two sides 260 and 280 that may or may not be mirror images. The example shows a mirror image of the two sides 260, 280. The rib 160 has two tabs 300, 320, that are at the bottom end of the rib 160. The top of the rib 160 includes two clasps 340, 360 and two grommet catches 380, 400. The clasps 340, 360 can join together so that the two sides attach from the top of the rib 160. The two grommet catches 380, 400 are inserted into the shower liner 120 (see FIG. 8). In this example, the two sides 260, 280 are unfolded, but the rib 160 can be hingedly connected by being folded at a mountain fold 250, a first valley fold 270 and a second valley 290 or hinge when attached to a shower liner 120. In its folded state, the rib 160 forms a mountain fold 250. The rib 160 attaches to the liner 120 via the tabs 300, 320 and two grommet catches 380, 400 on the rib (See FIG. 9).

Figure 10:
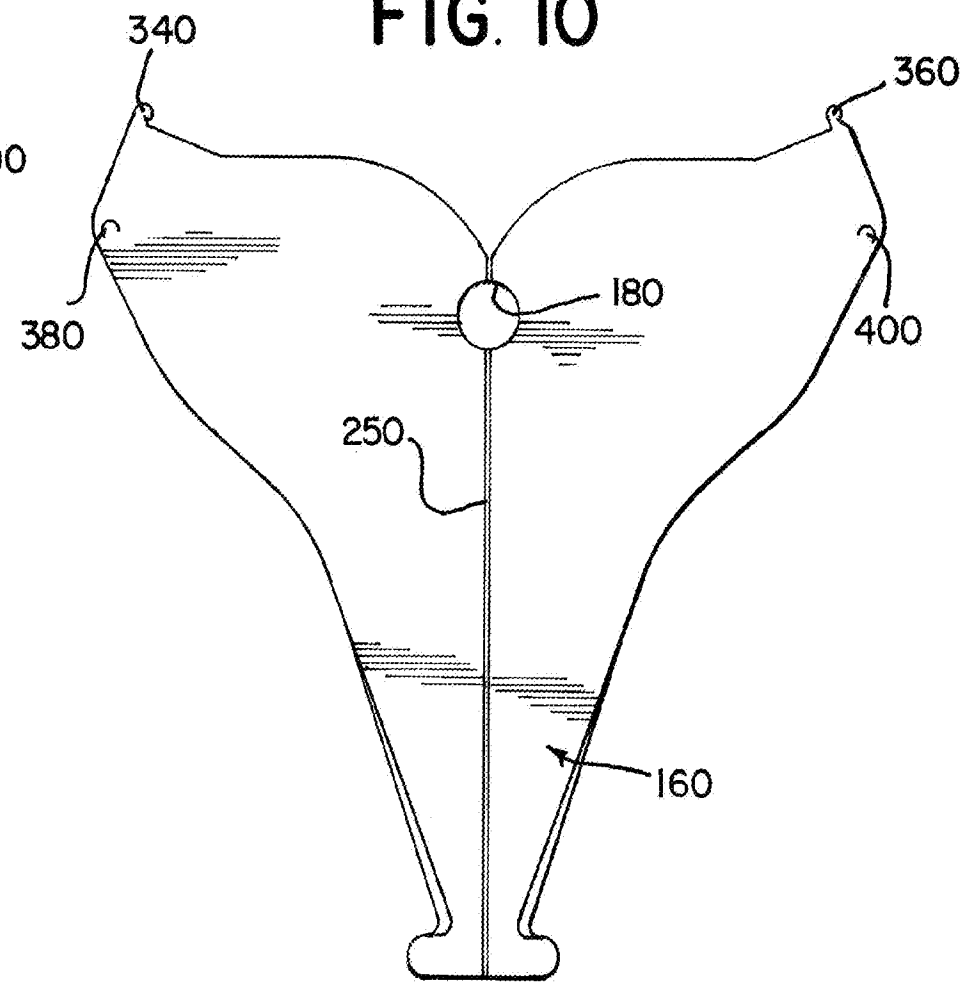
FIGS. 9 and 10 illustrate an example of a one-piece rib in a flat view of the shower curtain liner rib.

FIG. 10 is another embodiment of the rib 160 in a flat view. In this embodiment, the mountain fold 250 extends from the rod engager 180 all the way to the bottom of the rib 160. In other embodiments, there may be an aperture at the mountain fold 250.

Other examples of parts of the system 10 can be the shower liner 120 made of material know in the art for shower liners. The liner 120 can have two headers, the top header 240 and the second header 200. The top header 240 can be formed as known to ones of ordinary skill at the top of the liner 120 (to be disposed closest to the ceiling and/shower head 12). The top header 240 can have the standard spaced and number of grommet holes. This top header 240 can be engaged by any other standard shower curtain rings outside the scope of this invention.

The second header 200 can be formed in the same way as the top header 240 but in a non-standard location below the top header 240. The second header 200 can engage the rib 160 in numerous ways, slits, hook and loop, snaps, or other attachments known in the art. However, in one example, the liner 120 below the second header is not removable, nor does the second header 200 allow access from the dry side 140 to the shower side 220 of the liner 120. In other examples, the liner 120 below the second header 200 and the rib 160 can share an engagement point allowing both the rib 160 and the bottom of the liner to be removably engaged.

Turning to further examples of the rib 160, a back panel 260 can engage approximately perpendicularly to a strut. This can form an approximate "T" beam. The strut runs perpendicular to the liner 120 when the liner 120 and can form part of a "lever" that is balancing around the fulcrum formed by the engager 180 engaging the rod 14. It is the length and weight of the strut that forms part of the counterbalance to pull the liner 120 out. The liner 120 engages with the panel at both ends. The top of the panel side 260 engages the top header 240 of the liner 120. To secure the liner 120 to the panel 260 so the liner 120 can hang from the rod 14. The opposite end of the panel 260 engages the second header 200 to pull the liner 120. In an example, the opposite end is designed as such to keep the liner in between multiple ribs 160 generally taut. This tension keeps the liner 120 from sagging into the shower area 220.

While the foregoing has described what are considered to be the best mode and/or other examples, it is understood that various modifications may be made therein and that the subject matter disclosed herein may be implemented in various forms and examples, and that the teachings may be applied in numerous applications, only some of which have been described herein. It is intended by the following claims to claim any and all applications, modifications and variations that fall within the true scope of the present teachings.

What is claimed is:

1. A space creating shower liner system comprising:

a plurality of panels suspended from a shower rod, comprising:

a top, a bottom, a shower side and a dry side;

a counterbalance weight inherent in the plurality of panels;

a hook disposed on the dry side, and approximate the top of the panel, and rotatably and removably engaging the shower rod; and a plurality of stiffening folds providing partial stiffness to each of the plurality of panels; and a liner suspended from the plurality of panels and removably engaged approximate the bottom of the panels;

wherein the hook and the counterbalance weight cause the plurality of panels and the liner to rotate away from a user about the shower rod while suspended.

2. The space creating shower liner of claim 1, further comprising:

a curtain disposed over at least part of the plurality of panels and the liner.

3. The space creating shower liner of claim 1, wherein the hook is covered with a protective material.

* * * * *